United States Patent [19]

Noall

[11] 4,345,669

[45] Aug. 24, 1982

[54] WHEELCHAIR LIFT

[75] Inventor: Kenneth L. Noall, Ogden, Utah

[73] Assignee: Abex Corporation, New York, N.Y.

[21] Appl. No.: 184,509

[22] Filed: Sep. 5, 1980

[51] Int. Cl.[3] ..... B66B 9/06

[52] U.S. Cl. ..... 187/10; 187/13; 182/103

[58] Field of Search ..... 187/12, 10, 9 R, 13; 414/921; 182/103; 14/71.5

[56] References Cited

U.S. PATENT DOCUMENTS 1,838,204 12/1931 Wood ..... 187/12

3,014,556 12/1961 Stelzer ..... 187/12

3,592,294 7/1971 Allen ..... 187/12

4,133,437 1/1979 Gates ..... 414/921

*Primary Examiner*—Allen N. Knowles

*Attorney, Agent, or Firm*—Thomas S. Baker, Jr.; David A. Greenlee

[57] ABSTRACT

A lift for moving a wheelchair over a stairway includes a ramp, a wheelchair supporting platform and a mechanism for operating the platform over the ramp. When the lift is inoperative, the wheelchair supporting platform can be removed from the ramp and the ramp can be stored such that it does not intrude into the stairway and the operating mechanism is inaccessible.

14 Claims, 8 Drawing Figures

FIG. 4
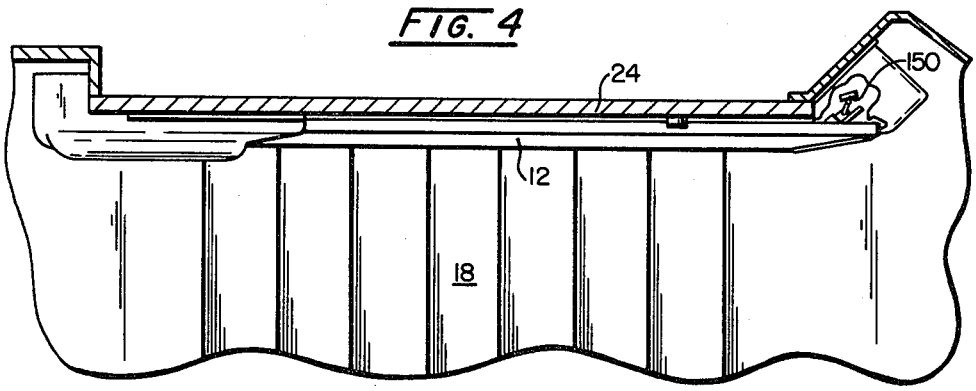
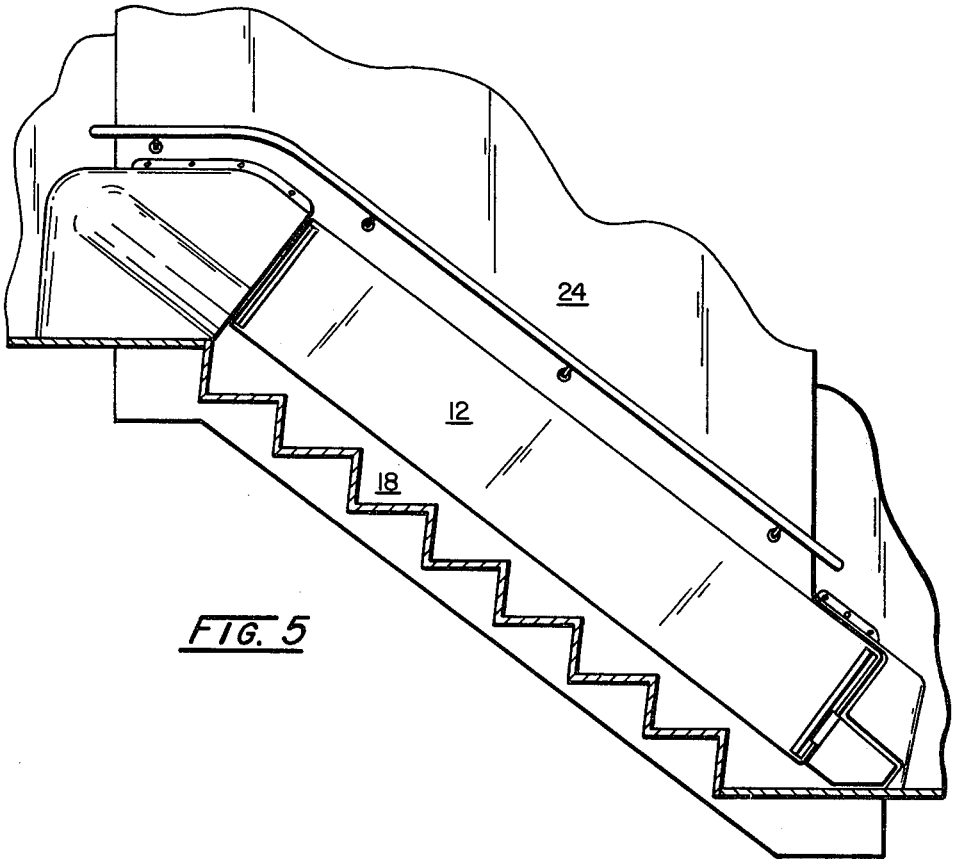
FIG. 5

WHEELCHAIR LIFT

BACKGROUND OF THE INVENTION

This invention relates to a lift for moving a wheelchair over a stairway.

The instant wheelchair lift was developed as a result of the development by the assignee of the instant invention of an aircraft passenger loading bridge which enables people to pass from the ground level of an airport to the door of an aircraft through a completely enclosed passageway. The ground level loading bridge is described in detail in U.S. Pat. No. 4,161,049 which is assigned to the assignee of the instant invention. Such a passenger loading bridge incorporates a stairway since, without the use of the stairway, the angle of the walkway from the entrance of the bridge to the exit at the doorway of the aircraft would be unacceptably steep. Use of a stairway presents a problem for transporting people in wheelchairs through the bridge. One common method of transporting a wheelchair over a stairway is to simply have people carry the wheelchair up and down the stairway. However, lifting a wheelchair over a stairway is slow, difficult and requires at least two people to handle the wheelchair. Consequently, the instant invention was developed to provide a device for quickly and easily transporting a person in a wheelchair over a stairway in a passenger loading bridge.

A number of wheelchair lift systems are presently available. However, most of these systems are not adaptable for use in the stairway of a passenger loading bridge for a variety of reasons. In some of the systems, the tracks or rails for guiding a chair supporting carriage or platform over the stairway project into the stairway when the system is not in use. In other systems the platform supporting a wheelchair cannot be detached from the carriage which moves it. Therefore, although the platform can be folded when not in use, it still projects a significant distance into the stairway and impedes the flow of passenger traffic over the stairway. An additional problem with most of the lift systems presently available is that they have a portion of their operating mechanism exposed when the lift is not in operation. A device having an exposed operating mechanism is not suitable for use in a public conveyance such as a passenger loading bridge.

In a lift used for moving a wheelchair over a stairway in a passenger loading bridge, it is desirable to be able to store the lift when it is not in use in such a manner that it does not project over the stairway and impede the movement of passengers using the stairway. Further, it is desirable to have a wheelchair lift in which the platform carrying the wheelchair can be removed from the carriage supporting the platform so that it can be stored out of the way of passenger traffic when not in use.

It is also desirable to have a wheelchair lift in which the operating mechanism is inaccessible when the lift is not in operation.

SUMMARY OF THE INVENTION

The wheelchair lift of the instant invention includes a ramp which lays upon the toes of the stairway treads when the lift is in operation. A carriage is connected to the ramp and a wheelchair supporting platform is mounted on and is movable with the carriage. Means are provided for moving the carriage over the ramp. When the wheelchair lift is not in use, it is stored vertically alongside the stairway and protrudes into the stairway about the same distance as a handrail. The platform for supporting the wheelchair is removable from the carriage and can be stored out of the way of passenger traffic over the stairway when the lift is not in operation.

DESCRIPTION OF THE DRAWINGS

FIG. 4 is a plan view of the stairway with the wheelchair lift in the stored position;

FIG. 5 is a side view, partially in section, of the stairway with the wheelchair lift in the stored position;

DESCRIPTION OF THE PREFERRED EMBODIMENT

Figure 1:
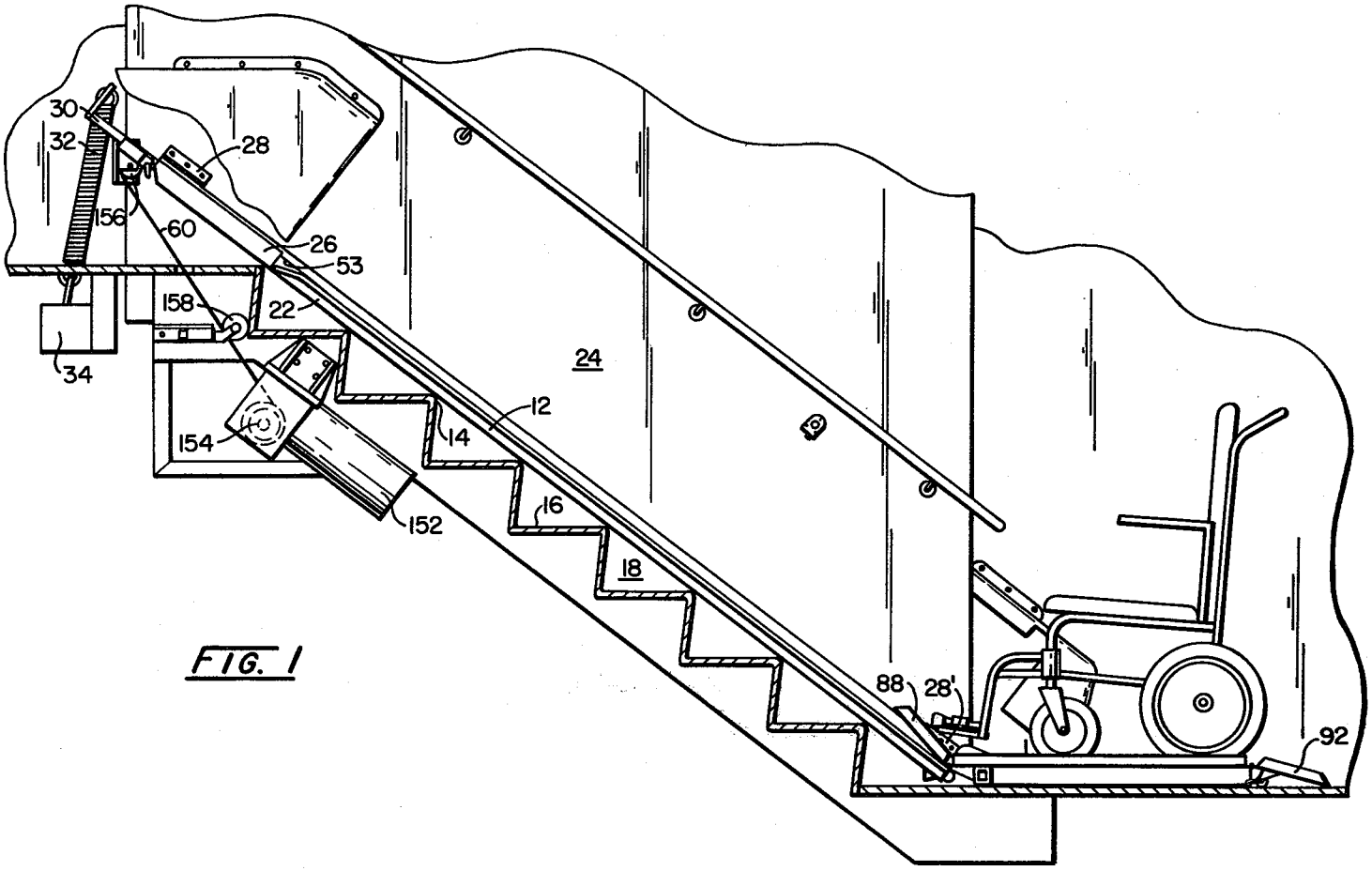
FIG. 1 is a side view, partially in section, of the wheelchair lift of the instant invention with the wheelchair support platform at the bottom of the ramp.
Figure 2:
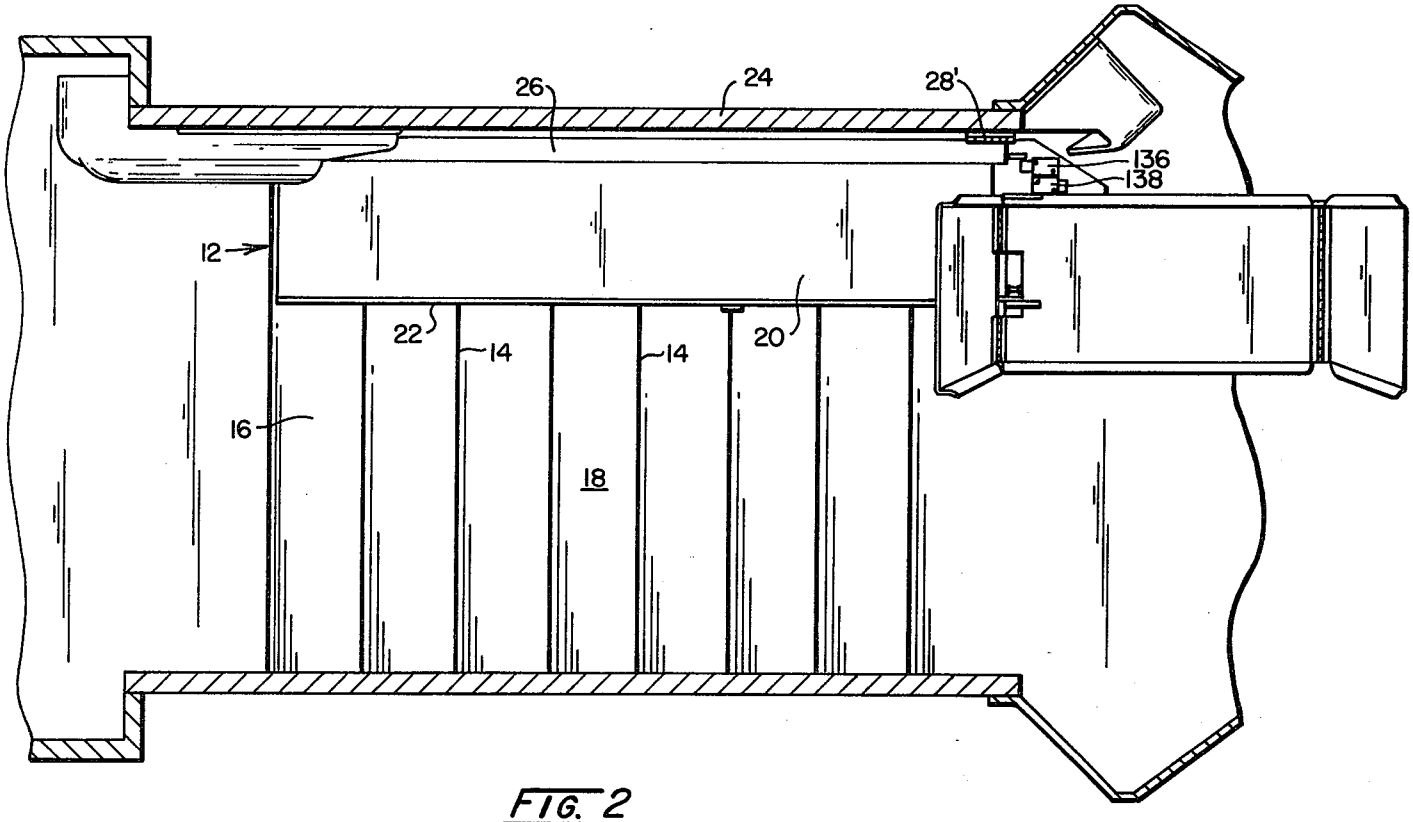
FIG. 2 is a plan view of the lift with the wheelchair support platform at the bottom of the ramp.
Figure 3:
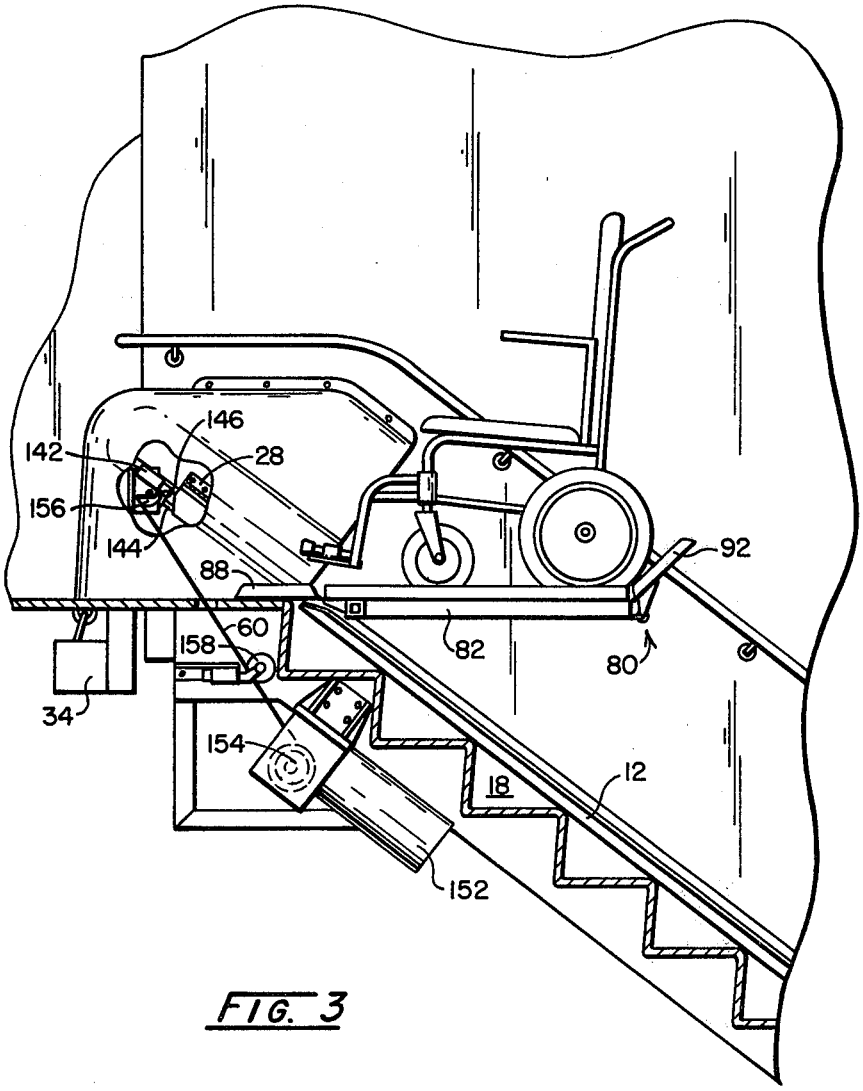
FIG. 3 is a side view, partially in section, of the upper portion of the lift with the wheelchair support platform at the top of the ramp.

Referring to FIGS. 1–3, a wheelchair lift is shown in the operative position. The lift includes a ramp 12 which rests on the toes 14 of the treads 16 of a stairway 18. Ramp 12 has a flat central portion 20 which is bounded along the side closest to the center line of the stairway 18 by an upturned lip 22 and is bounded on the side adjacent a wall 24 by a generally rectangular or box section 26. Ramp 12 is pivotally attached to wall 24 by a pair of hinges 28, 28' which are attached to opposite ends of box section 26.

An arm 30 is attached to and projects laterally from the end of box section 26 at the top of the stairway 18. A coil spring 32, which has one end attached to a structural support 34, located behind wall 24 and beneath stairway 18, has the other end attached to the distal end of arm 30. Spring 32 counterbalances the weight of ramp 12 in order to permit an operator to easily pivot the ramp 12 on its hinges 28, 28' between the operative position in which it lays horizontally on the stairway 18, as shown in FIGS. 1–3, and a stored position in which ramp 12 is parallel to wall 24, as shown in FIGS. 4 and 5. Spring 32 also biases ramp 12 against wall 24 to retain it in the stored position.

Figure 6:
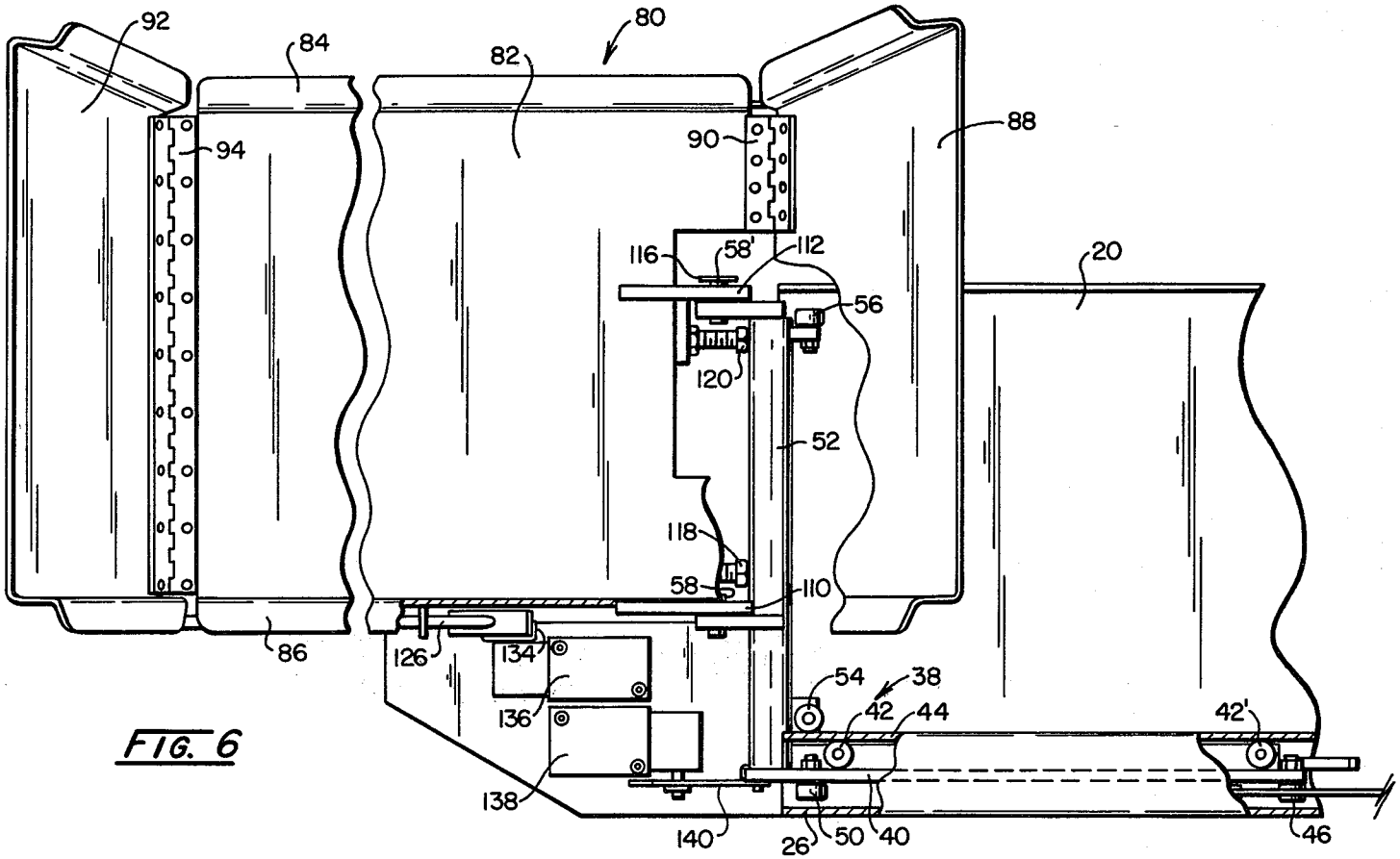
FIG. 6 is a plan view of the wheelchair support platform attached to the carriage assembly at the bottom of the ramp.
Figures 7, 8:
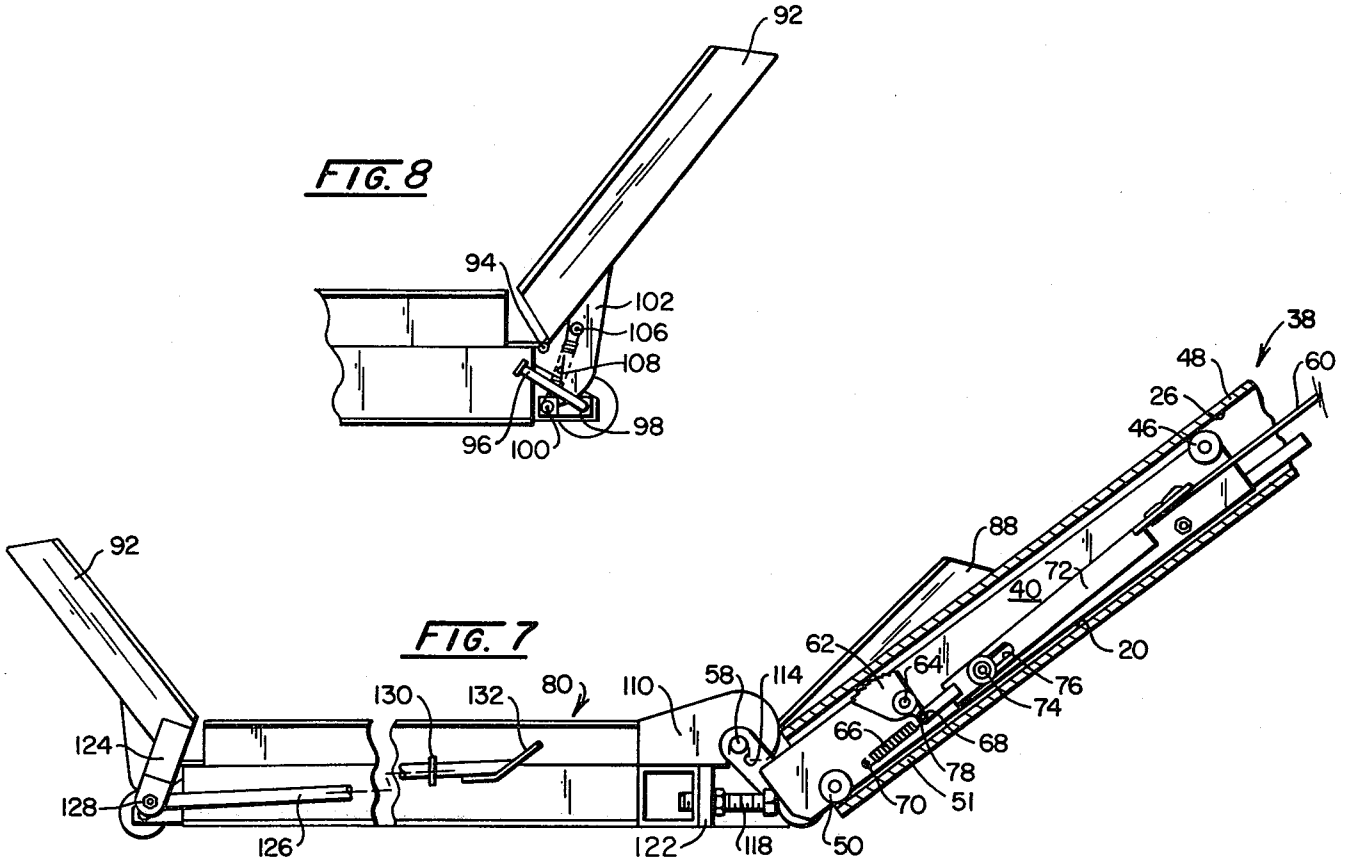
FIG. 7 is a side view showing the attachment of the wheelchair support platform to the carriage assembly.
FIG. 8 is a side view of the rear portion of the wheelchair support platform showing the mechanism which releases the rear entry ramp of the platform looking from the side opposite that shown in FIG. 7.

A carriage assembly 38 is mounted on and is movable over ramp 12. Assembly 38 includes a rigid, rectangular car member 40 confined inside of box section 26, as best seen in FIGS. 6 and 7. Car member 40 is guided in box section 26 by a plurality of rollers. A first pair of rollers 42, 42' are mounted along vertical axes on opposite ends of member 40. Rollers 42, 42' engage the inner surface of the inner vertical wall 44 of box section 26 which faces central portion 20. A second pair of rollers 46, 50 are mounted along horizontal axes on opposite ends of member 40. Roller 46 engages the inner surface of the top horizontal wall 48 of box section 26 and roller 50 engages the inner surface of the bottom horizontal wall 51. Wall 51 is parallel to the central portion 20 of ramp 12.

Carriage assembly 38 further includes an arm 52 which is rigidly connected to car member 40. Arm 52 extends through a slot 53 in vertical wall 44 of box section 26 and projects over the central portion 20 of ramp 12. A roller 54 is mounted along a vertical axis on arm 52 and engages the outer surface of vertical wall 44. A roller 56 is mounted on arm 52 along a horizontal axis aligned with the axis of roller 50. Roller 56 rests against the central portion 20 of ramp 12.

Referring to FIGS. 6 and 7, it can be seen that rollers 42, 42' and 54 engage vertical wall 44 and align carriage assembly 38 vertically with respect to box section 26, while rollers 46 and 50 engage horizontal walls 48 and 51, respectively, and align carriage assembly 38 horizontally with respect to box section 26. Roller 56 supports the outer end of assembly 38 on ramp 12. Consequently, car member 40 is guided horizontally and vertically in box section 26, and the outer end of arm 52 is supported on the central portion 20 of ramp 12 when the carriage assembly 38 is moved over ramp 12, as will be described hereinafter.

A pair of support lugs 58, 58' are mounted on carriage arm 52. One lug 58 is mounted at the end of arm 52 adjacent car member 40 and the other lug 58' is mounted at the end of the arm 52 near roller 56.

Referring to FIG. 7, the car member 40 includes a device which brakes the carriage assembly 38 in the event the cable 60, which moves the car member 40 through box section 26, breaks. The braking device includes a toothed section 62 which is mounted about a horizontal axis on a pin 64 attached to car member 40. A spring 66, which has one end attached to a pin 68 on toothed section 62 and the other end attached to a pin 70 mounted on member 40, biases section 62 clockwise into engagement with the top horizontal wall 48.

An arm 72 is connected to car member 40 by a fastener 74 which projects through an elongated slot 76 in the arm 72. When arm 72 is attached to car member 40, the pin 68 on section 62 projects into a bore 78 at one end of the arm 72. The cable 60 is attached to the other end of arm 72. When cable 60 is in tension, arm 72 rotates toothed section 62 counterclockwise against spring 66 and the toothed section 62 remains out of contact with the top wall 48 of box section 26. However, if cable 60 goes slack, spring 66 rotates toothed section 62 clockwise and the teeth on section 62 engage the top wall 48 to thereby prevent car member 40 from moving in section 26. This prevents carriage assembly 38 from moving until tension is restored to cable 60.

A wheelchair support platform 80 is mountable on and demountable from the carriage assembly 38. Referring again to FIGS. 6–8, it can be seen that the platform 80 includes a center member 62 which has a pair of longitudinally extending upturned sidewalls 84, 86. The sidewalls 84, 86 keep a wheelchair from moving laterally off of center member 82. A forward entry ramp 88 is pivotally connected to the front of center member 82 by a hinge 90. Forward entry ramp 88 is movable between a down position, in which the surface of the ramp 88 is level with that of center member 82 to discharge or receive a wheelchair when the carriage assembly 38 and wheelchair support platform 80 are at the top of a stairway, as shown in FIG. 3, and an up position shown in FIG. 1 that prevents a wheelchair from rolling forward off of center member 82. A rear entry ramp 92 is pivotally attached to the rear of center member 82 by a hinge 94. Rear entry ramp 92 is movable between a down position, in which the ramp 92 connects the center member 82 to the floor to receive or discharge a wheelchair when the carriage assembly 38 and wheelchair support platform 80 are at the bottom of a stairway, and an up position which prevents a wheelchair from rolling backward off of member 82.

The forward and rear entry ramps 88, 92 are retained in the up position by identical latch mechanisms. The latch mechanism which retains the rear entry ramp 92 in the up position is shown in FIG. 8. A tubular handle 96 is mounted on the rear of center member 82 adjacent rear entry ramp 92. An engagement rod 100 is attached to handle 96. A blade-shaped ramp support 102 is attached to the bottom of rear entry ramp 92. A spring 104 has one end attached to engagement rod 100 and the other end attached to a pin 106 mounted on ramp support 102. Spring 104 biases engagement rod 100 and handle 96 clockwise. When rear entry ramp 92 is in the up position, engagement rod 100 engages a leading edge 108 on ramp support 102 and prevents the ramp 92 from pivoting clockwise to the down position. In order to pivot entry ramp 92 from the up position to the down position, handle 96 is rotated counterclockwise until engagement rod 100 moves out of contact with leading edge 108 on ramp support 102. Although the latch mechanism for the front entry ramp 88 is not shown, it is identical to the latch mechanism for the rear entry ramp 92, as mentioned above.

Wheelchair support platform 80 is attached to carriage assembly 38 by a pair of support arms 110, 112. One support arm 110 is mounted on one side of and near the front of center member 82. The other support arm 112 is mounted near the center and at the front of center member 82. A portion of center member 82 adjacent front entry ramp 88 is cut away to allow support arm 112 to project above the surface of member 82. Each of the support arms 110, 112 has an elongated slot 114, 116, respectively. A pair of adjustable set screws 118, 120 are mounted in a lateral member 122 on platform 80 beneath the top surface of center member 82.

In order to mount wheelchair support platform 80 onto carriage assembly 38, the platform 80 is lowered onto carriage arm 52 so that lugs 58, 58' on arm 52 move onto the elongated slots 114, 116, respectively. When the lugs 58, 58' are at the end of the slots 114, 116, respectively, the set screws 118, 120 engage arm 52. The set screws 118, 120 are adjusted to make the support platform 80 level with the floor.

It is desirable to render the motor which operates the wheelchair lift as described below inoperative under certain conditions. These conditions are as follows: when the rear entry ramp 92 is down, when the ramp 12 is in the vertical or stored position, when the carriage assembly 38 and wheelchair platform 80 reach the top of the stairway 18 and when the carriage assembly 38 and wheelchair platform 80 reach the bottom of the stairway 18. The means for rendering the wheelchair lift inoperative under these conditions will now be described.

Referring to FIG. 7, an arm 124 is rigidly attached to one side of rear entry ramp 92. A rod 126 is pivotally connected to arm 124 through a pin 128 which is secured to the distal end of the arm 124. Rod 126 extends longitudinally along the side of platform 80 and projects through a guide 130. A plate 132 is secured to the end of the rod 126 which projects through guide 130.

Referring to FIGS. 2, 6 and 7, when rear entry ramp 92 is in the down position, arm 124 pivots counterclockwise, rod 126 is extended and plate 132 moves forward. In the forward position, plate 132 engages a spring-loaded arm 134 mounted on a safety switch 136 and rotates the arm clockwise. Safety switch 136 is connected to the circuit, not shown, which supplies current to the electric motor which operates the wheelchair lift. When arm 134 is in the clockwise position, switch 136 is open and current to the drive motor is interrupted. When rear entry ramp 92 is latched in the up position, arm 124 is pivoted clockwise, rod 126 is retracted, plate 132 does not engage arm 134 and switch 136 remains closed.

In order to stop the motor when the carriage assembly 38 and platform 80 reach the bottom of the stairway 18, a reverse limit switch 138 is positioned at the bottom of the stairway 18 adjacent switch 136. An actuating arm 140 projects forwardly from switch 138. When carriage assembly 38 reaches the bottom of stairway 18, the back end of car member 40 engages actuating arm 140 and pushes it counterclockwise to open switch 138. Switch 138 is connected to the circuit, not shown, which supplies current to operate the drive motor in the reverse mode to lower the carriage assembly 38. When switch 138 is open, the circuit is interrupted and the motor cannot operate in the reverse mode. However, the motor can operate in the forward mode.

A forward limit switch 142 interrupts operation of the motor when the carriage assembly 38 and platform 80 reach the top of stairway 18. Referring to FIG. 3, when carriage assembly 38 is at the top of stairway 18, an arm 144, which projects from the front of car member 40, engages an actuator 146 on switch 142 and opens the switch 142. Switch 142 is connected to the circuit, not shown, which supplies current to operate the drive motor in the forward mode and raise carriage assembly 38. When switch 142 is open, the circuit is interrupted and the motor cannot operate in the forward mode. However, the motor can operate in the reverse mode.

The drive motor is rendered inoperative when ramp 12 is in the stored position shown in FIG. 4. In this position, a cam member 150 mounted on the end of ramp 12 engages the actuating arm 134 of safety switch 136 to thereby open the switch 136 and render the drive motor inoperative.

Movement of the ramp 12 from the stored position to the operative position and operation of the wheelchair lift will now be described. Referring to FIGS. 4 and 5 which show ramp 12 in the vertical or stored position, an operator grasps one edge of ramp 12, releases a latch, not shown, and pivots the ramp 12 until it rests horizontally on the toes 14 of the stairway treads 16. This causes cam member 150 to move out of engagement with arm 134 on safety switch 136 to thereby close the switch 136. Referring to FIGS. 6 and 7, the wheelchair support platform 80 is mounted on carriage assembly 38 by lowering platform 80 onto the assembly 38 such that the lugs 58, 58′ on carriage arm 52 are received in the elongated slots 114, 116, respectively, on the platform 80. In order to move a wheelchair onto the wheelchair support platform 80, the latch mechanism for the rear entry ramp 92 is operated to move the ramp 92 to the down position. After the ramp 92 is latched in the up position. With the rear entry ramp 92 in the up position, plate 132 is out of engagement with arm 134 of safety switch 136 and the drive motor for the wheelchair lift can be operated.

The drive for the wheelchair lift of this invention includes an electric motor 152 which drives a pulley 154, as shown in FIGS. 1 and 3. Cable 60, which has one end attached to car member 40 of carriage assembly 38, passes over a first idler pulley 156 adjacent the top end of the box section 26 of ramp 12, a second idler pulley 158 beneath stairway 18 and has the other end attached to pulley 154. In order to move the wheelchair platform 80 from the bottom to the top of stairway 18, a key-operated switch, not shown, is actuated to operate drive motor 152 in the forward mode and cause cable 60 to be wound onto pulley 154. When the carriage assembly 38 reaches the top of the stairway 18, arm 144 on car member 40 engages actuator 146 on forward limit switch 142 and the forward mode circuit of the motor 152 is rendered inoperative. At the top of the stairway 18 the latch for the forward entry ramp 88 is operated to move the ramp 88 to the down position to permit the wheelchair to move off of platform 80.

In order to move a wheelchair from the top of stairway 18 to the bottom, a wheelchair is moved onto the support platform 80 and front entry ramp 88 is latched in the up position. A key-operated switch, not shown, is actuated to operate the drive motor 152 in the reverse mode. In this mode, carriage assembly 38 and platform 80 are lowered over ramp 12 as cable is unwound from pulley 154. When the carriage assembly 38 reaches the bottom of stairway 18, the rear of car member 40 engages arm 140 of reverse limit switch 138 and the circuit for operating the motor 152 in the reverse mode is rendered inoperative. At the bottom of the stairway 18 the rear entry ramp 92 is lowered and the wheelchair is removed.

In order to store the wheelchair lift of the instant invention, the wheelchair support platform 80 is lifted off of carriage assembly 38 for storage in a remote location, and ramp 12 is pivoted to the vertical or stored position against wall 24.

From the above it can be seen that the instant wheelchair lift provides a simple and efficient means for moving a wheelchair over a stairway. When not in use, the wheelchair support platform is removed and the ramp is stored against the wall, such that it does not project into the stairway. Further, when the lift is not in use, the operating mechanism is hidden. It should also be noted that when the wheelchair lift is in the operative position, it utilizes less than half the width of the stairway and the remaining portion of the stairway is available for conventional use.

Obviously, those skilled in the art may make various modifications in the details and arrangements of parts without departing from the spirit and scope of the invention as it is defined in the claims appended hereto. Applicant, therefore, wishes not to be restricted to the precise construction disclosed.

I claim:

1. A lift for moving a wheelchair over a stairway from a lower floor to an upper floor including a ramp, a carriage mounted adjacent the ramp, a wheelchair supporting platform attached to the carriage, means for moving the carriage and platform along the ramp, characterized by means for pivoting the ramp between a first position in which the ramp rests horizontally on top of the stairway and a second position in which the ramp is stored substantially vertically beside the stairway and intrusion of the ramp into the stairway is minimized.

2. The lift of claim 1, further characterized by means for counterbalancing the weight of the ramp and the counterbalance means biases the ramp toward the second position.

3. The lift of claim 1, further characterized by means for preventing operation of the platform moving means when the ramp is in the second position.

4. The lift of claim 1, further characterized by the wheelchair supporting platform including a rear entry ramp being movable between a lower position in which the entry ramp rests on the lower floor to receive a wheelchair and an upper position in which the entry ramp is raised to block a wheelchair from rolling off the wheelchair supporting platform, means for locking the rear entry ramp in the upper position and means for preventing operation of the platform moving means when the rear entry ramp is not in the upper position.

5. The lift of claim 1, wherein the ramp is generally flat and lies on top of the stairway toes.

6. A lift for moving a wheelchair over a stairway from a lower floor to an upper floor including a ramp, a carriage mounted in close proximity to the ramp, means for moving the carriage along the ramp and a wheelchair supporting platform attached to and movable with the carriage, means for pivoting the ramp between a first position in which the ramp rests horizontally on top of the stairway and a second position in which the ramp is stored substantially vertically beside the stairway characterized by the wheelchair supporting platform being detachably mounted on the carriage.

7. The lift of claim 6, further characterized by the wheelchair supporting platform including a support and the carriage including a lug, wherein the lug is received in the support when the wheelchair supporting platform is mounted on the carriage.

8. The lift of claim 7, further characterized by the wheelchair supporting platform including adjustment means which engage the carriage and level the wheelchair supporting platform when it is mounted on the carriage.

9. A lift for moving a wheelchair over a stairway including a ramp which extends substantially the length of the stairway, a carriage mounted in close proximity to the ramp, means for moving the carriage along the ramp and a wheelchair supporting platform mounted on and movable with the carriage, characterized by means for guiding the carriage, said guide means extends the length of the ramp, wherein one part of the carriage is confined within the guide means, another part of the carriage projects from the guide means substantially the entire width of the ramp and said other part of the carriage includes means for engaging the wheelchair supporting platform and attaching the platform to the carriage.

10. The lift of claim 9, further characterized by an adjustment means mounted on the wheelchair supporting platform for leveling the platform when it is mounted on the carriage.

11. The lift of claim 9, wherein the other part of the carriage includes an arm which extends laterally substantially the entire width of the ramp.

12. The lift of claim 11 including a support member mounted on the end of the arm remote from the guide means and the support member engages the top surface of the ramp to support the end of the arm.

13. The lift of claim 12, wherein the wheelchair supporting platform is detachably mounted on the arm.

14. The lift of claim 13, wherein a portion of the platform extends laterally beyond the ramp.

* * * * *

UNITED STATES PATENT OFFICE
CERTIFICATE OF CORRECTION

PATENT NO. : 4,345,669
DATED : August 24, 1982
INVENTOR(S) : Kenneth L. Noall

It is certified that error appears in the above-identified patent and that said Letters Patent are hereby corrected as shown below:

Col. 3, line 56 - "62" should read --82--

Col. 5, line 64 - after "the" insert --wheelchair is moved onto the support platform 80, the--

Signed and Sealed this

*Second* Day of *November 1982*

[SEAL]

*Attest:*

GERALD J. MOSSINGHOFF

*Attesting Officer* *Commissioner of Patents and Trademarks*